United States Patent [19]

Andresen et al.

[11] 4,055,373

[45] Oct. 25, 1977

[54] FURNITURE CONSTRUCTION SYSTEM

[75] Inventors: Peter B. Andresen; Claus Winter, both of Hamburg; Siegfried H. Hendel, Mannheim, all of Germany

[73] Assignee: Inbauproduct Innenausbausysteme GmbH & Co., KG, Hamburg, Germany

[21] Appl. No.: 620,184

[22] Filed: Oct. 6, 1975

[30] Foreign Application Priority Data

Oct. 4, 1974 Germany ..... 2447414

[51] Int. Cl.[2] ..... A47B 87/00

[52] U.S. Cl. ..... 312/263; 312/108; 312/198; 108/61; 211/184

[58] Field of Search ..... 312/263, 198, 111; 108/61; 211/184; 52/753

[56] References Cited

U.S. PATENT DOCUMENTS

| | | | |
|---|---|---|---|
| 1,493,431 | 5/1924 | Fries et al. | 108/61 |
| 1,677,544 | 7/1928 | Brainard et al. | 211/184 |
| 2,112,498 | 3/1938 | Lax | 312/263 |
| 2,721,632 | 10/1955 | Surpierre | 108/61 |
| 2,838,355 | 6/1958 | Crowther | 312/263 |
| 3,407,547 | 10/1968 | Duke et al. | 312/108 |
| 3,604,774 | 9/1971 | Furman | 312/263 |
| 3,656,786 | 4/1972 | Larson | 211/184 |
| 3,822,924 | 7/1974 | Lust | 312/263 |

FOREIGN PATENT DOCUMENTS

| | | | |
|---|---|---|---|
| 912,240 | 10/1946 | France | 52/753.9 |

*Primary Examiner*—Paul R. Gilliam
*Assistant Examiner*—Victor N. Sakran
*Attorney, Agent, or Firm*—Stevens, Davis, Miller & Mosher

[57] ABSTRACT

A furniture construction comprising a plurality of plate elements arranged horizontally and vertically according to choice, of the same thickness and each having hole rows in the region of two oppositely lying edges of the plate element and of angle brackets for fixing the plate elements to one another with the aid of screws or the like, the distance between centers of the holes in the hole rows being the same as the thickness of the plate elements and the first and last holes of at least one plate element being at a distance from the edge of the plate element equal to the thickness thereof and the first and last holes of at least one other plate element being at a distance from the edge of the plate element of half the thickness of the plate element.

4 Claims, 8 Drawing Figures

FURNITURE CONSTRUCTION SYSTEM

This invention relates to a furniture construction system which consists of plate elements arranged as desired vertically or horizontally, of the same thickness and with rows of holes in the region of two adjacently lying edges of the plate elements, and of angle brackets for fixing the plate elements to one another with the aid of screws or the like.

It is known to build the walls of cupboards and furniture by means of previously prepared vertically running rows of holes in the wall parts as well as cut screws fitting therein and angled brackets.

With the aid of these elements, varied covered wall, shelving and furniture combinations can be made up using previously manufactured constructional parts which can be erected by the user. By the use of self-tapping fixing screws, only simply bored holes without a thread are necessary. The plate-shaped side or intermediate walls are provided with vertical rows of fixing holes, the interhole distance being about double that of the wall thickness of the material or chosen at will.

These known cupboard, wall and furniture construction systems have the disadvantage that two vertical rows of fixing holes lack the arrangement for a simple wall thickness. Furthermore this arrangement of hole rows forbids the building in of vertical intermediate walls according to choice, the building in of doors as vertically opening flaps and vice versa according to choice, unless additional changes to the constructional parts are undertaken.

The present invention seeks to provide a furniture construction system which can give many combination possibilities with only a few constructional parts, particularly such a system enabling vertical intermediate walls to be installed according to choice. The furniture construction system according to the invention makes it possible to construct furniture of combinations of both vertical and horizontal plate elements.

According to the present invention there is provided a furniture construction comprising a plurality of plate elements arranged horizontally and vertically according to choice, of the same thickness and each having hole rows in the region of two oppositely lying edges of the plate element and of angle brackets for fixing the plate elements to one another with the aid of screws or the like, the distance between centers of the holes in the hole rows being the same as the thickness of the plate elements and the first and last holes of at least one plate element being at a distance from the edge of the plate element equal to the thickness thereof and the first and last holes of at least one other plate element being at a distance from the edge of the plate element of half the thickness of the plate element.

Using the two types of plate elements, various combination pieces of furniture can be made. Furthermore between two given vertical and two given horizontal plate elements, intermediate walls can be arranged either vertically or horizontally without the need for other constructional elements as is the case with known types of construction. The presence of horizontal hole rows parallel to the edges of horizontal construction parts enables vertical intermediate walls and flaps to be inserted as desired in the furniture construction systems of the invention.

An important feature of the invention arising from the arrangement of the holes in the hole rows consists in the ability to construct a satisfactory cross-connection of four wall plates, two of each type. The plates may also be joined together using brackets to form T-connections and angle connections. Because of the spacing of the holes from the edges, a cross-connection can be made in which the holes in both horizontal and vertical fixing hole rows are equidistant from the central planes of the two pairs of plates.

The new furniture construction system which is erected with the aid of angle brackets matching unitarily with the hole row arrangement and self tapping screws fitting therein gives rise to a plurality of combination possibilities with much diminished storage requirements. All sorts of arrangements can be constructed from preformed plates, even by the do-it-yourself constructor, without additional alteration of the constructional parts, without subsequent working on them and without having to store a number of special constructional parts.

The use of a basic shape of plates with rows of holes in it for horizontal and vertical construction of parts enables both the customary building in of doors and the mounting of vertically opening flaps of any size and the exchange of doors for flaps and vice versa without subsequent working or special parts. As well as mounting cross, T- and angle connections, division into a number of vertical or horizontal compartments as well as the arrangement of incomplete vertical intermediate walls is possible in economic fashion with the aid of the new constructional system.

The furniture construction system according to the invention is also suitable for room dividers made of modular construction parts.

For the furniture construction as mentioned above it is necessary to use at least two plate elements, one plate element having a distance between hole centers equal to the thickness of the plate element, and the first and the last hole in the hole row having a distance from the edge of the plate element of half the thickness of the plate element. The other plate element has a distance between hole centers equal to the thickness of the plate element and the first and the last hole in the hole row have a distance equal to half the thickness of the plate element to the edges.

To avoid the use of two different plate elements it is possible in accordance with a further embodiment of the present invention to have the distances between hole centers in a hole row equal to half the thickness of the element and to have the distance of the first and the last hole in the hole row of the plate element from the edge equal to half the thickness of the element. In accordance with this embodiment of the present invention only one form of plate elements is necessary.

Embodiments of the invention are illustrated by way of Example in the drawing in which.

Figure 6:
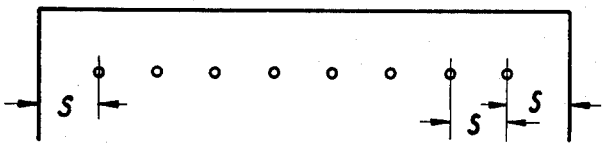
Figure 6A:
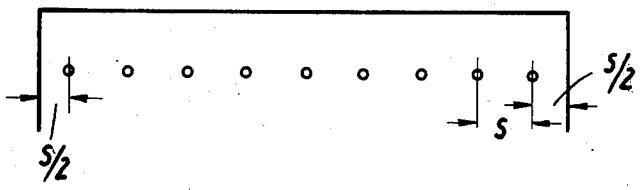
Figure 6B:
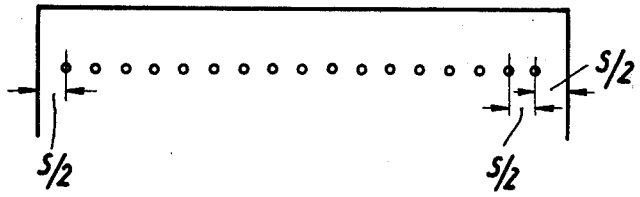

FIGS. 6, 6*a* and 6*b* show the three different plate elements in part in accordance with the present invention.

Figure 3:
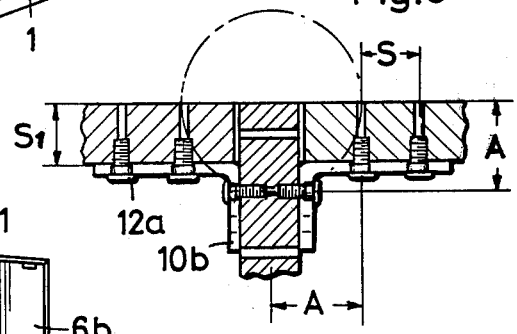
FIG. 3 is a cross-section of a T-connection according to the invention.
Figure 4:
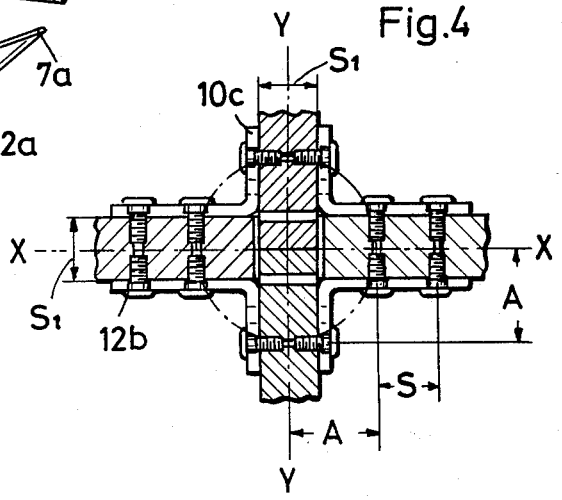
FIG. 4 is a cross-section of a cross-connection according to the invention.

In the figures vertical walls 3, 3*a*, 4 and 4*a* are provided with vertical hole rows 2 and 2*a* which have a hole distance S which corresponds to the wall thickness $S_1$ of plate elements 3, 3*a*, 4, 4*a* . . . 7, 7*a*. The plate elements are put together in desired fashion with the aid of angle brackets 10, 10*a*, 10*b*, 10*c* and self-tapping screws 12, 12*a*, 12*b*. Thus angle or T-connections according to FIG. 3 and horizontal or vertical cross-connections according to FIG. 4 can be assembled with the same similarly produced parts without change or subsequent work. Because of the arrangement of the holes relative to the edges of the plate elements, cross-connections can be made in which the rows of visible holes each commence at a distance A (= 1.5S) from the centre of the connection (where planes XX and YY in FIG. 4 intersect). The T-connection shown in FIG. 3 is made in the same way though using a different part of bracket 10 for engagement with self-tapping screws 12*a*.

The vertical fixing hole rows 2, 2*a* serve both for fixing horizontal walls 5, 5*a* or shelves 8 and for building in doors 6, 6*a* 6*b* by means of door hinges 11 and the self-tapping screws 12, 12*a*, 12*b* which cut their thread themselves on introducing into the holes.

As well as the vertical hole rows there are also horizontally running hole rows 1, 1*a* on the preferably horizontally mounted construction parts although their use is also possible as vertical walls.

With the aid of the horizonal hole rows 1, 1*a*, vertical intermediate walls 4, 4*a* or vertical partitions 9 can be built in at any place desired between horizontal walls.

Figure 5:
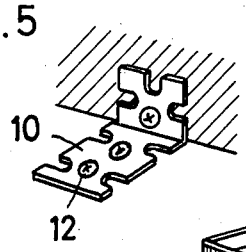
FIG. 5 is an angled bracket shown in situ.
Figure 1:
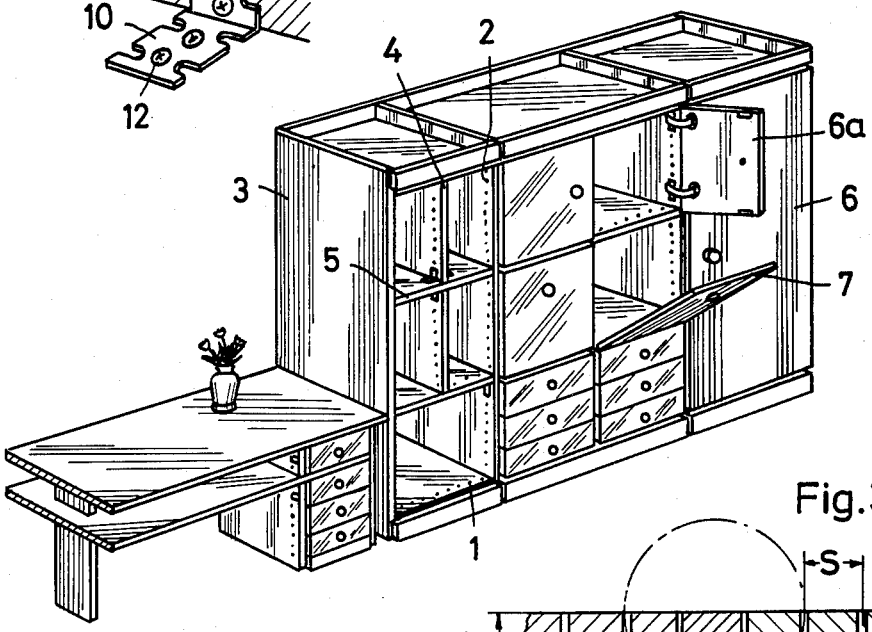
FIG. 1 shows a perspective view of a wall cupboard incorporating a writing table.
Figure 2:
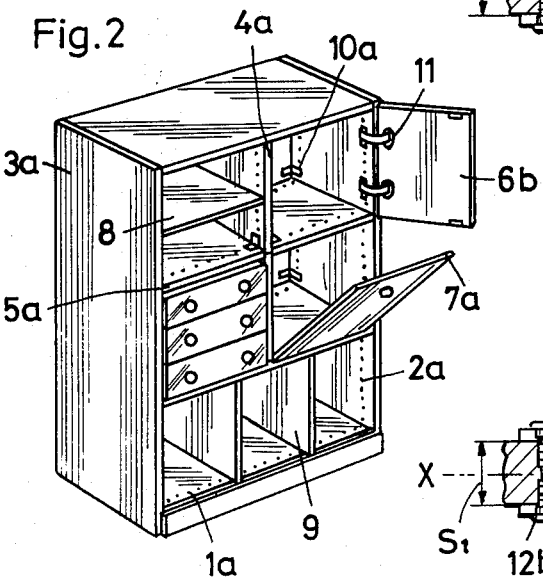
FIG. 2 is a perspective view of a wall unit according to the invention with non-continuous vertical intermediate wall and exchangeable door and exchangeable flap.

As is especially evident from FIGS. 1 and 2, the horizontal hole rows allow doors 6*a*, 6*b* or flaps 7, 7*a* to be mounted according to choice and to be exchanged.

As shown in the FIGS. 6, 6*a* and 6*b* there are three embodiments of plate elements in accordance with the present invention whereby S is the thickness of the plate elements.

FIG. 6 shows a plate element with a distance between hole centers S and the distance between the first and the last hole in the hole row and the edge of S.

FIG. 6*a* shows a plate element with the same distances between hole centers S but with a distance between the edges and the first and the last hole in the hole row of S/2.

Using plate elements like these a plurality of combinations is possible and only two different forms of plate elements are necessary.

FIG. 6*b* shows a plate element having the same plurality of possible combinations but needing only one form of plate elements because the distances between hole centers and the distance of the first and the last hole in a hole row from the neighbouring edge of the plate element are identical, namely S/2.

We claim:

1. In a furniture construction system in which furniture is made from a plurality of plate elements arranged horizontally and vertically according to choice, of the same thickness and each plate element having hole rows in the region of two oppositely lying edges of the plate element, angle brackets for fixing the plate elements to one another, and fixing elements such as screws for fixing the brackets to the plate elements, the improvement which comprises making the distances between centers of the holes in the hole rows the same as the thickness of the plate elements, and setting the first and last holes of at least one plate element at a distance from the edge of the plate element equal to the thickness thereof and the first and last holes of at least one other plate element at a distance from the edge of the plate element of half the thickness of the plate element.

2. In a furniture construction comprising a T-joint formed of three abutting plate elements each having hole rows adjacent edges of the plate elements running away from the joint and angle brackets connected to the plate elements by fixing members engaging the holes, the improvement which comprises setting the distances between centers of the holes in the hole rows equal to the thickness of the plate elements, the first hole in each hole row of the two coplanar sheet elements being the thickness of the sheet elements from the edge thereof and the first hole in the hole rows of the third sheet element being at a distance of half the thickness of the sheet element from the edge of the sheet element.

3. In a furniture construction comprising a cross-joint formed of four abutting plate elements in two planes at right angles, the plate elements each having hole rows adjacent edges of the plate elements running away from the joint and angle brackets connected to the plate elements by fixing members engaging the holes, the improvement which comprises setting the distances between centers of the holes in the hole rows equal to the thickness of the plate elements, the first hole in each hole row of two coplanar sheet elements being the thickness of the sheet elements from the edge thereof and the first hole in the hole rows of the other two sheet elements being at a distance of half the thickness of the sheet element from the edge of the sheet element.

4. A furniture construction comprising a plurality of plate elements arranged horizontally and vertically according to choice, of the same thickness and each having hole rows in the region of two oppositely lying edges of the plate element and of angle brackets for fixing the plate elements to one another with the aid of screws or the like, characterized in that the distance between centers of the holes in each hole rows being identical to half of the thickness of the plate elements and the distance of the first and the last hole in a hole row from the edge of the plate element being also half of the thickness of the plate element.

* * * * *